US010733830B2

(12) United States Patent
Jadeja

(10) Patent No.: US 10,733,830 B2
(45) Date of Patent: Aug. 4, 2020

(54) GAMING MACHINE DISPLAY HAVING ONE OR MORE CURVED EDGES

(71) Applicant: Aristocrat Technologies Australia Pty Limited, North Ryde (AU)

(72) Inventor: Rajendrasinh B. Jadeja, Las Vegas, NV (US)

(73) Assignee: Aristocrat Technologies Pty Limited, North Ryde, NSW (AU)

( * ) Notice: Subject to any disclaimer, the term of this patent is extended or adjusted under 35 U.S.C. 154(b) by 0 days.

(21) Appl. No.: 16/224,661

(22) Filed: Dec. 18, 2018

(65) Prior Publication Data

US 2020/0193767 A1 Jun. 18, 2020

(51) Int. Cl.
*G07F 17/32* (2006.01)

(52) U.S. Cl.
CPC ..... *G07F 17/3211* (2013.01); *G07F 17/323* (2013.01); *G07F 17/3209* (2013.01); *G07F 17/3223* (2013.01); *G07F 17/3227* (2013.01); *G07F 17/3239* (2013.01)

(58) Field of Classification Search
None
See application file for complete search history.

(56) References Cited

U.S. PATENT DOCUMENTS

D370,058 S 5/1996 Bostrom
7,364,505 B2 * 4/2008 Mattice ..... G07F 17/32 273/138.1
7,396,282 B2 * 7/2008 Gauselmann ..... G07F 17/3211 463/30
8,128,483 B2 * 3/2012 Vann ..... G07F 17/3202 463/16
D667,412 S 9/2012 Wang
8,442,600 B1 5/2013 Tseng
D700,605 S 3/2014 Hong
D714,270 S 9/2014 Lee
D719,116 S 12/2014 Bang
8,951,121 B2 2/2015 Lyons et al.
D730,857 S 6/2015 Park
(Continued)

OTHER PUBLICATIONS

U.S. Appl. No. 29/673,951, filed Dec. 18, 2018, Jadeja.
(Continued)

*Primary Examiner* — Lawrence S Galka
(74) *Attorney, Agent, or Firm* — Weaver Austin Villeneuve & Sampson LLP

(57) ABSTRACT

A display for an electronic gaming machine (EGM) may have a display including a main display portion and one or more curved display side portions. In some examples, the EGM may include a sensor system residing at least in part on the one or more curved display side portions. A control system may be configured to cause the main display portion to display one or more images corresponding to a touch, gesture or force detected by the sensor system. One or more of the curved display side portions may be used to display images corresponding to virtual control devices and/or an attract sequence for a game. In some instances, one or more of the curved display side portions may be used to display images corresponding to an attract sequence, player identification information and/or advertising while the main display portion is being used to present an instance of the wagering game.

20 Claims, 7 Drawing Sheets

(56) References Cited

U.S. PATENT DOCUMENTS

| | | | | |
|---|---|---|---|---|
| D740,241 | S | 10/2015 | Kim | |
| D744,990 | S | 12/2015 | Lee | |
| D748,082 | S | 1/2016 | Lee | |
| 9,256,250 | B2 | 2/2016 | Raff et al. | |
| 9,367,095 | B2 | 6/2016 | Myers | |
| 9,478,097 | B2 | 10/2016 | Hennessy et al. | |
| D778,365 | S | 2/2017 | Kott | |
| 9,614,168 | B2 | 4/2017 | Zhang | |
| D843,466 | S | 3/2019 | Castro | |
| D847,109 | S | 4/2019 | Kang | |
| 10,303,218 | B2 | 5/2019 | Jones | |
| D850,536 | S | 6/2019 | Stair | |
| D862,295 | S | 10/2019 | Kim | |
| D863,122 | S | 10/2019 | Cha | |
| D870,820 | S | 12/2019 | Urban | |
| D871,506 | S | 12/2019 | Castro | |
| D871,507 | S | 12/2019 | Urban | |
| 2009/0143141 | A1* | 6/2009 | Wells | G07F 17/32 463/37 |
| 2010/0062838 | A1 | 3/2010 | Nguyen et al. | |
| 2012/0004030 | A1* | 1/2012 | Kelly | G07F 17/3211 463/31 |
| 2013/0217491 | A1 | 8/2013 | Hilbert et al. | |
| 2013/0296057 | A1 | 11/2013 | Gagner et al. | |
| 2013/0331184 | A1 | 12/2013 | Kelly et al. | |
| 2015/0168792 | A1 | 6/2015 | Woo | |
| 2016/0055703 | A1* | 2/2016 | Woels | G07F 17/3213 463/20 |
| 2016/0274719 | A1 | 9/2016 | Burr et al. | |
| 2016/0364941 | A1 | 12/2016 | Castro et al. | |
| 2017/0118849 | A1 | 4/2017 | Kim | |
| 2017/0153671 | A1 | 6/2017 | Yamazaki | |
| 2017/0178444 | A1* | 6/2017 | Lee | G07F 17/326 |
| 2018/0270975 | A1 | 9/2018 | Ishikawa | |
| 2019/0096169 | A1 | 3/2019 | Tovar et al. | |
| 2019/0102975 | A1* | 4/2019 | Lapalme | G06F 3/03547 |
| 2019/0150332 | A1 | 5/2019 | Son | |
| 2019/0273217 | A1 | 9/2019 | Lee | |

OTHER PUBLICATIONS

Office Action dated Nov. 1, 2019, for U.S. Appl. No. 16/209,900 (pp. 1-14).

Notice of Allowance dated Apr. 22, 2020 for U.S. Appl. No. 16/209,900 (pp. 1-11).

U.S. Office Action dated Apr. 30, 2020 for U.S. Appl. No. 29/673,951 (pp. 1-12).

LG OLED displays to feature smartphone style curved edges?, (C) 2019 [online], [retrieved Apr. 16, 2020], Retrieved from Internet, URL: <https://www.avforunns.conn/news/lg-oled-displays-to-feature-snnartphone-style-curved-edges.16774> (Year: 2019).

Oppo shows off 'waterfall screen' phone with ultra-curved edges, (C) 2019 [online], [retrieved Apr. 16, 2020], Retrieved from Internet, URL: https://www.theverge.conn/circuitbreaker/2019/7/29/8934593/oppo-waterfall-display-phone-curved-screen-announced> (Year : 2019).

* cited by examiner

GAMING MACHINE DISPLAY HAVING ONE OR MORE CURVED EDGES

CROSS-REFERENCE TO RELATED APPLICATION

This application is related to U.S. Pat. No. 29,673,951, entitled "DISPLAY WITH CURVED EDGES FOR AN ELECTRONIC GAMING MACHINE" and filed on Dec. 18, 2018, which is hereby incorporated by reference and for all purposes.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

A display system for an EGM may have a display that includes a main display portion and one or more curved display side portions. In some examples, the display may include a sensor system residing at least in part on the one or more curved display side portions. A control system may be configured to cause the main display portion to display one or more images corresponding to a touch, gesture or force detected by the sensor system. One or more of the curved display side portions may be used to display images corresponding to virtual control devices. In some instances, one or more of the curved display side portions may be used to display images corresponding to an attract sequence, player identification information, advertising or other content. According to some implementations, one or more of the curved display side portions may be used to display images corresponding to an attract sequence, player identification information, advertising or other content while the main display portion is being used to present an instance of the wagering game.

DETAILED DESCRIPTION

Figure 1:
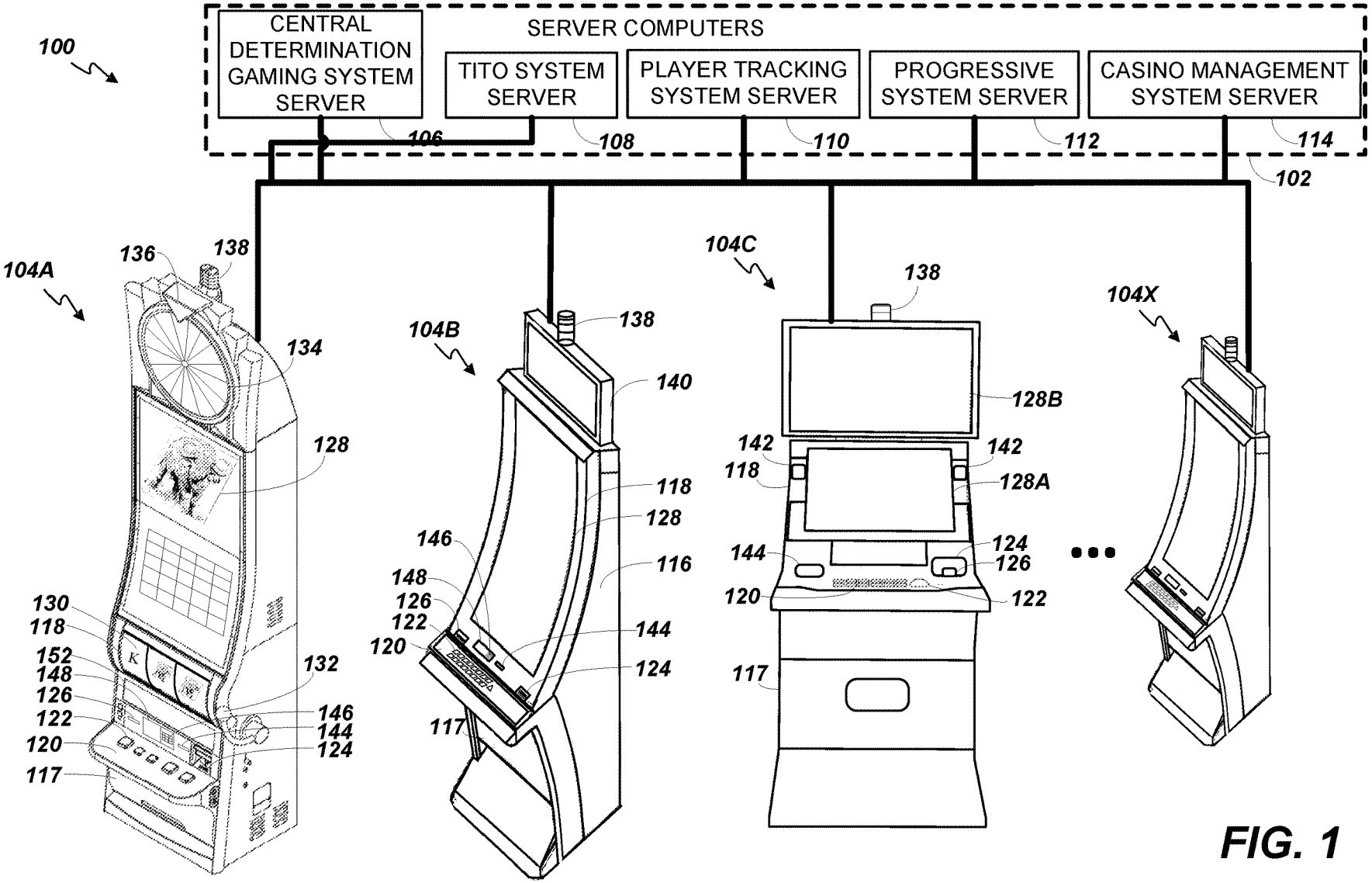
FIG. 1 is a diagram showing examples of several EGMs networked with various gaming related servers.

FIG. 1 illustrates several different models of EGMs which may be networked to various gaming related servers. The present invention can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the present invention may, in one or more embodiments, be practiced on a stand-alone gaming device such as gaming device 104A, gaming device 1046 or any of the other gaming devices 104C-104X. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 117 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
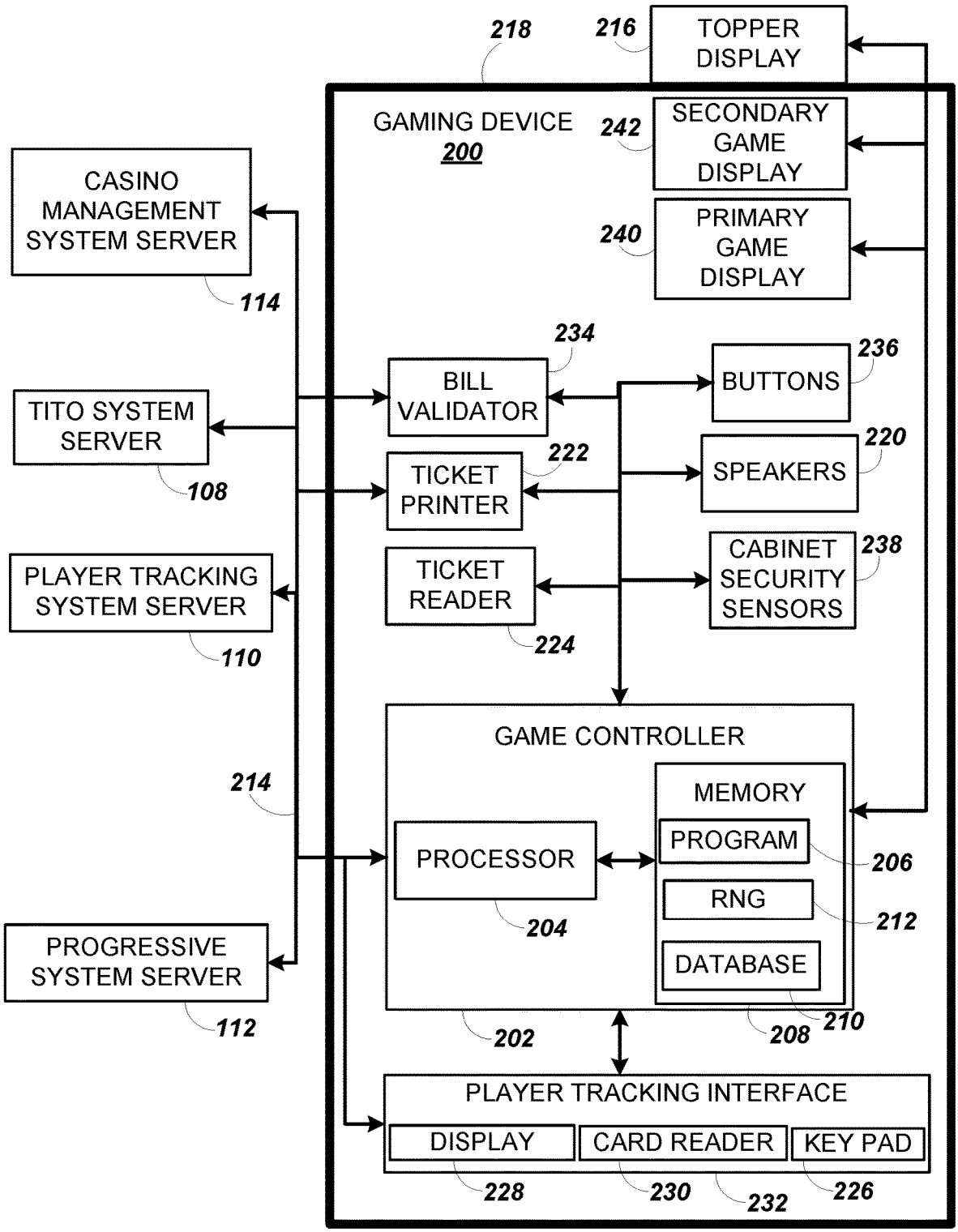
FIG. 2 is a block diagram showing examples of various functional elements of an EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the present invention necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 117 which opens to provide access to the interior of the gaming device 1046. The main or service door 117 is typically used by service personnel to refill the ticket-out printer 126 and collect bills and tickets inserted into the bill validator 124. The door 117 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 1286 is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting examples of internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

Alternatively, a game instance (i.e. a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), and a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Figure 3:
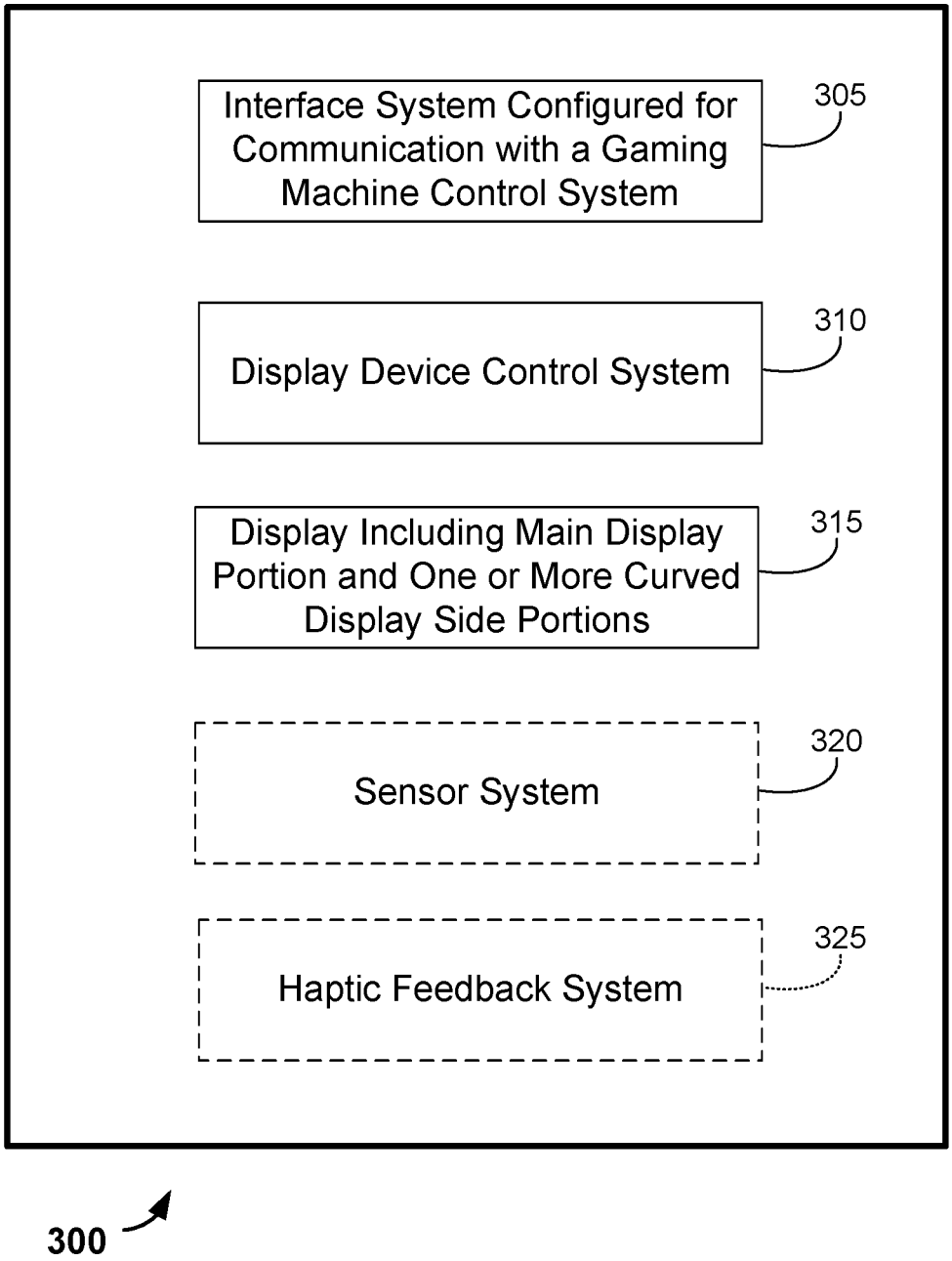
FIG. 3 is a block diagram that shows blocks of a display device for a gaming machine according to one example.

FIG. 3 is a block diagram that shows blocks of a display device for a gaming machine according to one example. According to this example, the display device 300 includes an interface system 305, a display device control system 310 and a display 315. In some examples, the display device 300 may include an optional sensor system 320 and/or an optional haptic feedback system 325.

The interface system 305 provides one or more interfaces for wired and/or wireless communications between the display device 300 and an EGM, e.g., by electrical connectivity. In this implementation, the interface system 305 is configured for communication between the display device 300 and at least a portion of a gaming machine control system. The gaming machine control system may be, or may include, an instance of the game controller 202 described above with reference to FIG. 2. In some disclosed implementations, the display device 300 may receive information from a player tracking system via the interface system 305. As noted above, some disclosed EGMs may include a player tracking card reader, a transceiver for wireless communication with a player's smartphone, a keypad and/or an illuminated display for reading, receiving, entering, and/or displaying player tracking information. In some examples, the display device 300 may receive player tracking information, which may include but is not limited to player identification information, from the player tracking system via the interface system 305. In some implementations, the player tracking information may be received via a gaming machine control system. In other implementations, the player tracking information may be received from the EGM's player tracking system and/or from a player tracking system server via the interface system 305.

In this example, the display device control system 310 is configured for controlling elements of the display device 300. In some instances, the display device control system 310 may be configured for controlling elements of the display device 300 at least in part according to signals received from an EGM via the interface system 305. In some such examples, the display device control system 310 may be configured for controlling elements of the display device 300 at least in part according to signals received from a gaming machine control system via the interface system 305. Alternatively, or additionally, the display device control system 310 may be configured for controlling elements of the display device 300 at least in part according to signals received from another component of the EGM, such as a player tracking module, or at least in part according to signals received from another device.

The display device control system 310 may include at least one of a general purpose single- or multi-chip processor, a digital signal processor (DSP), an application specific integrated circuit (ASIC), a field programmable gate array (FPGA) or other programmable logic device, discrete gate or transistor logic, or discrete hardware components. Accordingly, the display device control system 310 may include one or more processors. In some implementations the display device control system 310 may include one or more non-transitory storage media operatively coupled to the one or more processors.

In some examples, the display device control system 310 may be configured for sending signals (via the interface system 305) corresponding to input received via the optional sensor system 320 to a gaming machine control system. In some such examples, the signals may be, or may correspond to, user input received via the optional sensor system 320. Some examples are described below.

The display 315 may, in some implementations, be an instance of the main display 128 that is described elsewhere herein. The display 315 may be, or may include, a liquid crystal display (LCD), plasma, a light-emitting diode (LED) display, microLED or organic light-emitting diode (OLED) panel. According to some implementations, the display 315 may include a flexible OLED.

In this implementation, the display 315 includes a main display portion and one or more curved display side portions. According to some examples, one or more of the curved display side portions and/or the main display portion may be used to display images corresponding to virtual control devices. In some instances, one or more of the curved display side portions may be used to display images corresponding to an attract sequence, player identification information, advertising or other content. According to some implementations, one or more of the curved display side portions may be used to display images corresponding to an attract sequence, player identification information, advertising or other content while the main display portion is being used to present an instance of the wagering game.

Depending on the particular implementation, the sensor system 320 may be configured for touch, gesture and/or force detection. For example, the sensor system 320 may include a capacitive, optical and/or ultrasonic sensor that is configured for touch, gesture and/or force detection. In some examples, the sensor system may include a screen, such as a touch screen, that overlies at least a portion of the display 315. For example, the sensor system 320 may reside, at least in part, on one or more curved display side portions of the display 315. According to some examples, the sensor system may include one or more touch, force or gesture-sensitive buttons.

In some implementations, the display device control system 310 may be configured to cause the main display portion to display one or more images corresponding to a touch, gesture or force detected by the sensor system 320. In some instances, the touch, gesture or force may correspond to at least one of a player hand or a player digit.

The display device 300 may, in some examples, include a haptic feedback system 325. The haptic feedback system 325 may be configured to provide haptic feedback corresponding to one or more touches or gestures detected via the sensor system 320. Accordingly, haptic feedback system 325 may reside on, under or proximate at least a portion of the sensor system 320. Some examples are described in more detail below.

Figure 4A:
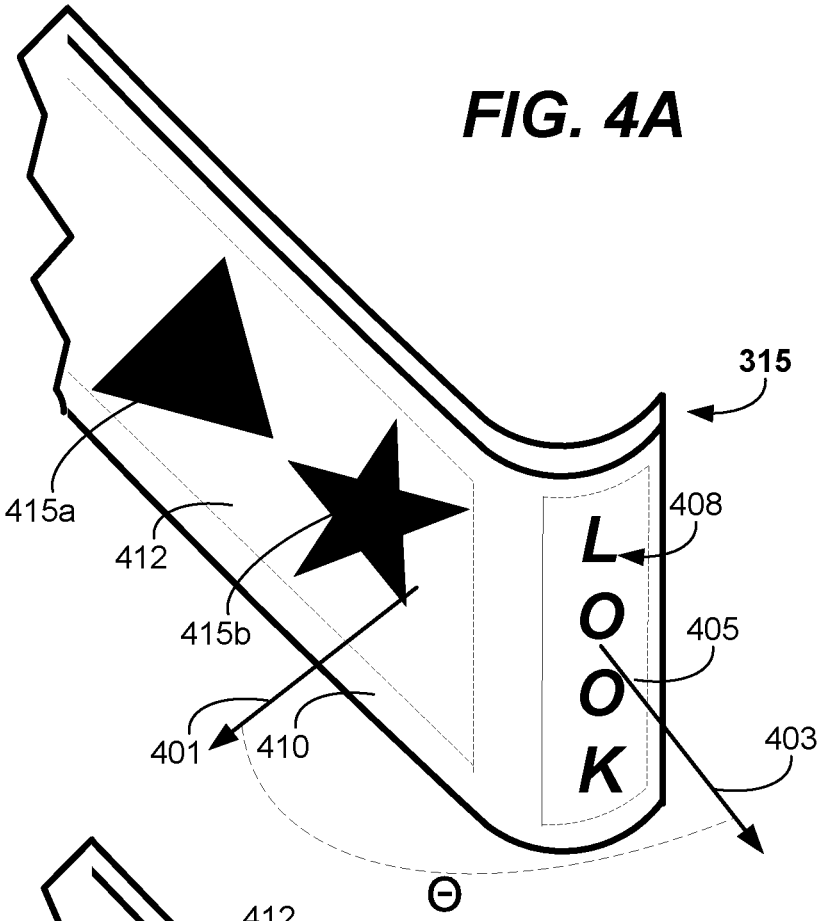
FIGS. 4A-4C shows example perspective views of a display having a main display portion and at least one curved display portion.
Figure 4B:
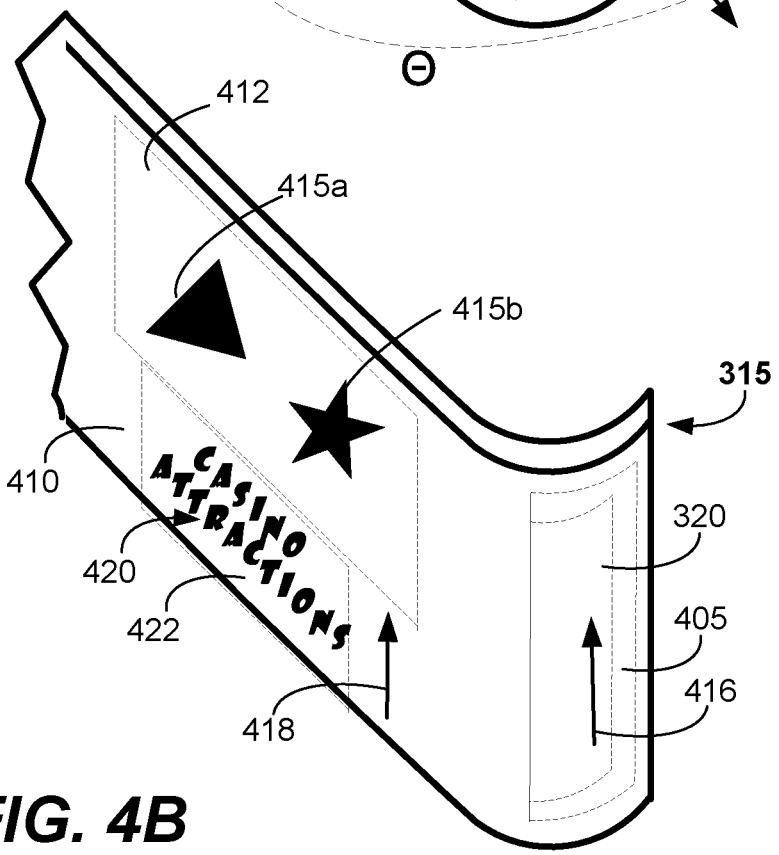
Figure 4C:
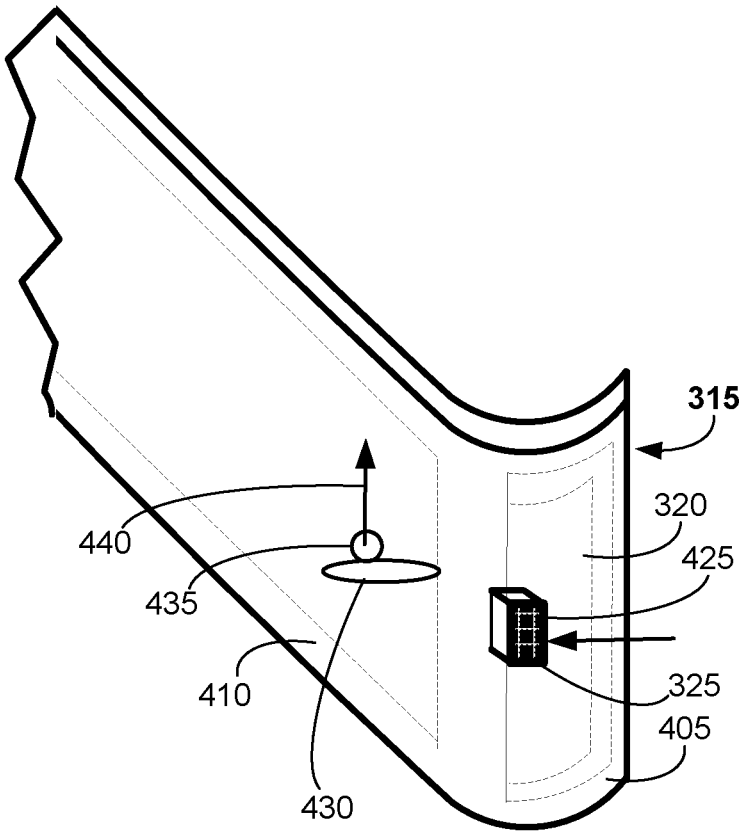

FIGS. 4A-4C shows example perspective views of a display having a main display portion and at least one curved display portion. In these examples, the main display portion 410 corresponds to a front portion of the display 315. The broken lines shown in FIGS. 4A-4C indicate that the entire display 315 is not shown. In the examples shown in FIGS. 4A-4C, only one curved display portion 405, on a side visible to a person viewing the drawing, is shown. However some or all of these implementations may include a corresponding curved display portion 405, e.g., on an opposing side of the main display portion 410 relative to the curved display portion 405 that is visible in FIGS. 4A-4C.

In the example shown in FIG. 4A, a display device control system is causing the images 415*a* and 415*b* to be displayed in an area 412 of the main display portion 410 at the same time that the images 408 are being displayed on the curved display portion 405. The images 415*a* and 415*b* may, for example, be displayed during a process of presenting an instance of a wagering game on the main display portion 410. The images 408 may, for example, be displayed during an attract sequence, may be advertising images used for advertising a product or service, may correspond to player identification information, etc. Accordingly, the images 408, 415*a* and 415*b* may, for example, be displayed according to signals received from a gaming machine control system (e.g., via an interface system such as the interface system 305 shown in FIG. 3).

As shown in FIG. 4A, one potential advantage of a display having a main display portion 410 and at least one curved display portion 405 is that the main display portion 410 and the curved display portion 405 may be viewable from very different angles. In the example shown in FIG. 4A, the arrow 401 represents a normal to the flat, or substantially flat, surface of the main display portion 410. In this example, the arrow 403 represents a normal to a portion of the surface of the curved display portion 405. In some examples, the angle θ between the arrow 401 and the arrow 403 may be approximately 70 degrees, approximately 80 degrees, approximately 90 degrees, etc., depending on the particular implementation. This angle may depend, for example, on the curvature of the curved display portion 405 and on the particular location on the surface of the curved display portion 405 for which a normal is determined.

However, regardless of the particular angle, in many such implementations the images 408 that are presented on the curved display portion 405 may be readily viewable by people other than a person currently using an EGM to which the display 315 is attached. For example, if the EGM is located in an aisle of a casino, the images 408 that are presented on the curved display portion 405 may be readily viewable by people who are looking in the direction of the EGM, e.g., by people who are walking down the aisle in the direction of the EGM. However, the images 408 presented on the curved display portion 405 may or may not be readily viewable by a person who is currently using the EGM, depending on the particular implementation.

Therefore, one potential advantage of a display 315 such as that shown in FIG. 4A is that one or more of the curved display portions 405 may be used to display an attract sequence, advertising images, player identification information, game information, etc., that may be viewed from one or more sides of an EGM that includes the display 315. In some examples, one or more of the curved display portions 405 may be used to display such images while the main display portion 410 is being used to present an instance of a wagering game. According to some examples, a color, color sequence, image and/or image sequence displayed on the one or more of the curved display portions 405 may be used to indicate an award, a bonus level, or another event related to an instance of a wagering game. In one such example, a color displayed on the one or more of the curved display portions 405 may correspond with a bonus level, e.g., with increasingly "hot" colors indicating relatively higher bonus levels. For example, a yellow color may correspond with a relatively low bonus level, an orange color may correspond with a moderate bonus level and a red color may correspond with a high bonus level. In this way, nearby casino patrons may be made aware of a player's successful outcomes.

FIG. 4B shows an implementation in which the sensor system 320 resides, at least in part, one or more of the curved display side portions 405. In this example, a display device control system is configured to cause the main display portion 410 to display one or more images corresponding to a touch, gesture or force detected by the sensor system 320. In this example, prior to the instant depicted by FIG. 4B, the main display portion 410 was displaying images as shown in FIG. 4A. Here, the sensor system 320 has detected a touch or gesture corresponding to the movement of a player's hand or a player's digit in the direction of the arrow 416. In alternative examples, the sensor system 320 may have detected a force corresponding in the direction of the arrow 416.

According to this example, the display device control system is configured to cause, in response to the touch, gesture or force in the direction of the arrow 416, the area 412 to move upwards (in the direction of the arrow 418) and to display images 420 in the area 422. In this example, the images 420 correspond to a service, a product and/or a type of entertainment. Here, the images 420 correspond to a service, a product and/or a type of entertainment provided within the casino in which the EGM resides. According to some examples, the images 420 may, for example, be displayed according to signals received from a gaming machine control system (e.g., via an interface system such as the interface system 305 shown in FIG. 3).

Touches, gestures and/or forces detected by the sensor system 320 may be used in various other ways, depending on the particular implementation. In some such implementations, touches, gestures and/or forces detected by the sensor system 320 may be used to provide functionality for a gaming technician to display diagnostic information on the display 315, to display information regarding software updates and/or accounting information (such as meters, charts, graphs, spreadsheet information, etc.). According to some such implementations, the sensor system 320 may be capable of capturing one or more types of biometric information, such as fingerprint image data. In some such examples, the sensor system 320 may provide one or more types of captured biometric information to a control system (such as the display device control system 310 or a control system of an EGM) that is configured for authentication functionality. In such implementations, the sensor system 320 may be part of an authentication system for controlling access to EGM information, to ensure that only an authorized gaming technician has access to such information. In some alternative implementations, a display device control system may be configured to cause at least one of the curved display side portions 405 to display one or more virtual control devices. According to some examples, the display device control system may be configured to cause the main display portion 410 to display one or more virtual control devices. In some such examples, the same virtual control device, and/or corresponding virtual control device, may be displayed on the main display portion 410 and on at least one of the curved display side portions 405. In response to a touch, gesture or force detected by the sensor system 320, the display device control system may be configured to control the display 315 to indicate corresponding movement of one or more virtual control devices. According to some examples, one or more virtual control devices may be displayed based, at least in part, on signals received from a gaming machine control system.

FIG. 4C shows examples of virtual control devices displayed on a display having a main display portion and at least one curved display portion. According to this example, the display device 300 includes a sensor system 320 that is disposed (at least in part) on the curved display side portion 405. Here, a control system of the display device 300 is configured to control the display 315 to display images corresponding to user input such as movement, a touch, force or pressure changes, etc., detected by the sensor system 430.

In the example, shown in FIG. 4C, the user input corresponds to a user's interaction with the sensor system 320 to cause a simulated movement of virtual control devices, which include virtual button 425 and virtual paddle 430 in this example. According to this example, the virtual button 425 is displayed on both the curved display side portion 405 and the main display portion 410, whereas the virtual paddle 430 is displayed only on the main display portion 410.

Here, the display device control system is configured to control the display 315 to display images corresponding to movement of virtual paddle 430 in response to user input received by the sensor system 320 in the area in which the virtual button 425 is being displayed. In some such examples, the display device control system is configured to control the display 315 to display images corresponding to movement of virtual paddle 430 in response to input from a gaming machine control system.

For example, the display device and the EGM may be configured to provide a skill-based game. The skill-based game may, in some examples, be provided as a bonus game after a trigger event in a wagering game, such as a winning symbol or card combination. In this example, the skill-based game involves interacting with one or more instances of the virtual button 425 in order to control the virtual paddle 430 to shoot the ball 435 towards one or more targets. The targets may be displayed on the display 315 and/or on another portion of the gaming machine, depending on the particular implementation. In some such implementations, at least one target may be displayed by a display other than the display 315, such as a display that is positioned above the display 315 (e.g., a topper display). Other implementations may provide other types of virtual control devices, such as a virtual joystick. Some such virtual control devices can provide relatively more user interactions and/or game functions.

In some such implementations, the display device control system may be configured to determine trajectory information, such as trajectory information corresponding with the trajectory represented by the arrow 440. The trajectory information may, for example, include a speed and a direction corresponding with a user's interaction with the virtual paddle 430 and the virtual button 425 via input to the sensor system 320. For example, the display device control system may determine the trajectory information according to instructions, such as software, stored on one or more non-transitory media. The display device control system may be configured to control the display 315 to display one or more images (such as images of the ball 435) moving along a trajectory corresponding to the trajectory information. In some such examples, the display device control system may be configured to send, via the interface system, at least some of the trajectory information to the gaming machine control system.

However, in some examples the gaming machine control system may be configured to determine the trajectory information. For example, the display device may be configured to send, via the interface system, signals to the gaming machine control system corresponding to the touch, gesture or force detected by the sensor system 320. The gaming machine control system may be configured to determine the trajectory information based, at least in part, on the signals detected by the sensor system 320. The gaming machine control system may be configured to provide the trajectory information to the display device control system. The display device control system may be configured to cause the display 315 (e.g., the main display portion 410) to display one or more images corresponding to a touch, gesture or force detected by the sensor system based, at least in part, on trajectory information signals from the gaming machine control system.

In this example, the display device includes a haptic feedback system 325 that resides, at least in part, in an area corresponding to the location of the curved display side portion 405 in which the virtual button 425 is being displayed. The haptic feedback system 325 may be configured to provide haptic feedback corresponding to force, touches, gestures, etc., detected via the sensor system, including but not limited to touches or gestures corresponding to interaction with virtual control device images. For example, in some implementations the haptic feedback system 325 may be configured to provide haptic feedback corresponding to movement of the virtual button 425, movement of the virtual paddle 430, contact of a virtual paddle 430 with the ball 435, etc.

Figure 5:
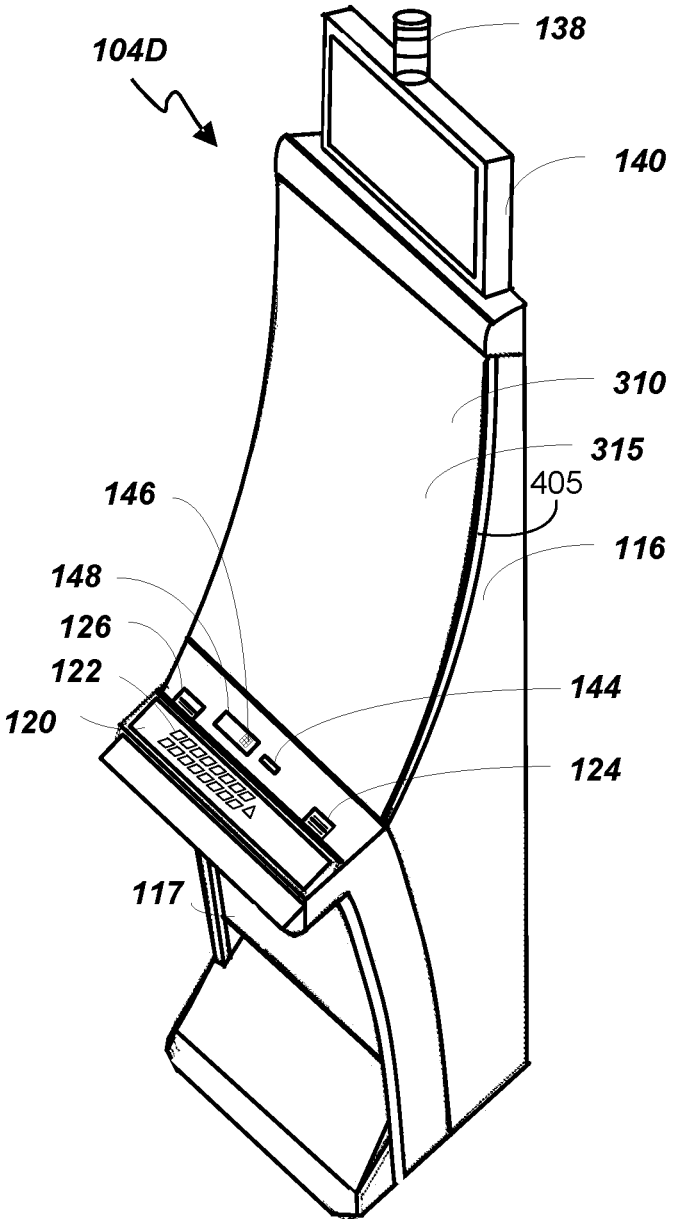
FIG. 5 shows an example of an EGM that includes one example of a display device such as those disclosed herein.

FIG. 5 shows an example of an EGM that includes one example of a display device such as those disclosed herein. In this example, the EGM 104D is similar to the EGM 104B shown in FIG. 1, the main difference being that the EGM 104D includes a display 315 that includes a main display portion 410 and curved display side portions 405. Only one of the curved display side portions 405 is visible in FIG. 5.

According to some such examples, the display device's interface system may be configured to receive player tracking information, including but not limited to player identification information from the gaming machine control system. The display device control system may be configured to cause at least one of the curved display side portions 405 to display one or more images, colors, etc., corresponding with the player identification information. According to some such implementations, the display device control system may be configured to cause one or more of the curved display side portions 405 to display a color that corresponds with a player's level in a casino player loyalty program, e.g., gold, silver, etc. The gaming machine may, for example, include a wireless interface system that is configured to receive player tracking information, including but not limited to the player identification information, from a player loyalty card or from a mobile device. The wireless interface system may, for example, be configured for Bluetooth communication, infrared communication and/or near-field wireless communication.

According to some implementations, the display device control system may be configured to cause, based at least in part on signals from the gaming machine control system, at least one of the curved display side portions 405 to display one or more images corresponding to a portion of an attract sequence for a game while the gaming machine control system causes at least one other gaming machine component (such as the topper screen 140) to display one or more images corresponding to another portion of the attract sequence.

Figure 6:
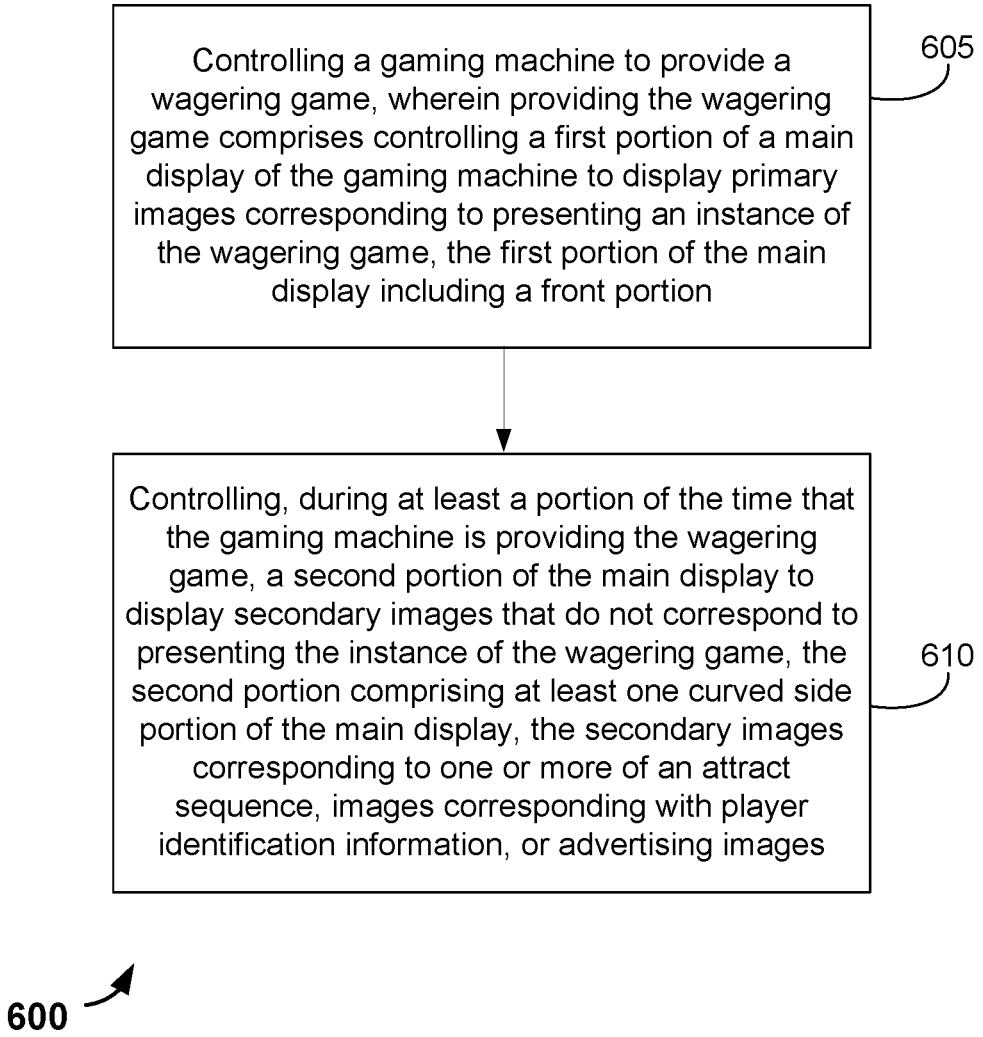
FIG. 6 is a flow diagram that shows blocks of a method according to one implementation.

FIG. 6 is a flow diagram that shows blocks of a method according to one implementation. Method 600 may be implemented, at least in part, by a display device 300 as disclosed herein. In some examples, methods performed by the display device 300 may be implemented, at least in part, by a control system (such as a gaming machine control system and/or the display device control system 310 that is described above with reference to FIG. 3) according to software stored upon one or more non-transitory storage media of, or accessible by, the control system. As with other methods described herein, the number and sequence of blocks shown in FIG. 6 are merely examples. Similar disclosed methods may include more or fewer blocks.

According to this example, block 605 involves controlling a gaming machine to provide a wagering game. In this example, providing the wagering game involves controlling a first portion of a main display of the gaming machine to display primary images corresponding to presenting an instance of the wagering game. Here, the first portion of the main display includes a front portion, which may correspond to the main display portion 410 described above.

In this implementation, block 610 involves controlling, during at least a portion of the time that the gaming machine is providing the wagering game, a second portion of the main display to display secondary images that do not correspond to presenting the instance of the wagering game. In this example, the second portion includes at least one curved side portion of the main display, such as one of the curved display side portions 405 that are described above. According to this example, the secondary images correspond to an attract sequence, player identification information images, or advertising images.

According to some examples, the secondary images may be viewable from an angle that is perpendicular to a normal to the first portion of the main display. Referring to FIG. 4A, for example, the secondary images may be viewable from an angle corresponding to the arrow 405. The direction represented by the arrow 405 may, in some examples, be perpendicular to the direction represented by the arrow 401, which is normal to the main display portion 410.

Accordingly, the images 408 that are presented on the curved display portion 405 may be readily viewable by people other than a person currently using an EGM to which the display 315 is attached. If the EGM is located in an aisle of a casino, the images 408 that are presented on the curved display portion 405 may be readily viewable by people who are looking in the direction of the EGM. However, the images 408 presented on the curved display portion 405 may or may not be readily viewable by a person who is currently using the EGM, depending on the particular implementation.

Returning to FIG. 6, in some examples the method 600 may involve receiving first identification information regarding a first person for whom the instance of the wagering game is being presented and receiving second identification information regarding a second person who is not currently playing the wagering game. The second person may nonetheless be in the vicinity of the EGM. The second identification information may, for example, be received via a wireless interface system that is configured to receive identification information from a player loyalty card or from a mobile device. In some such examples, block 610 may involve controlling the second portion of the main display to display secondary images corresponding with the second identification information. According to some such implementations, the secondary images do not correspond with the first identification information. In other words, such implementations may involve displaying images on at least one curved side portion of the main display that correspond to identification information for a person who is not currently playing the EGM.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

The invention claimed is:

1. An apparatus that includes a display device for a gaming machine, the display device comprising:

an interface system configured for communication with at least a portion of a gaming machine control system;

a display device control system;

a display having a main display portion and one or more curved display side portions; and a sensor system that is configured for at least one of touch, gesture or force detection, the sensor system residing at least in part on the one or more curved display side portions, wherein:

the display device control system is configured to cause the main display portion to display one or more images corresponding to a touch, gesture or force detected by the sensor system;

the interface system is configured to receive player tracking information from the gaming machine control system; and the display device control system is configured to cause at least the one or more curved display side portions to display one or more colors or images corresponding with the player tracking information.

2. The display apparatus of claim 1, wherein the display device control system is configured to cause, in response to the touch, gesture or force and based at least in part on signals received from the gaming machine control system, an area of the main display portion to display one or more images corresponding to one or more of a service, a product or a type of entertainment.

3. The display apparatus of claim 2, wherein, prior to the touch, gesture or force being detected by the sensor system, the display device control system is configured to cause, based at least in part on signals received from the gaming machine control system, the area of the main display portion to display one or more game-related images.

4. The display apparatus of claim 1, wherein the display device control system is configured to cause, based at least in part on signals received from the gaming machine control system, at least one of the curved display side portions to display one or more images corresponding to an attract sequence for a game.

5. The display apparatus of claim 1, wherein the display device control system is configured to cause, based at least in part on signals received from the gaming machine control system, at least one of the curved display side portions to display one or more virtual control devices and, in response to the touch, gesture or force, to control the display to indicate corresponding movement of the one or more virtual control devices.

6. The display apparatus of claim 5, wherein the one or more virtual control devices comprise at least one of a virtual button or a virtual joystick.

7. The display apparatus of claim 5, further comprising a haptic feedback system, wherein the display device control system is configured to control the haptic feedback system to provide haptic feedback corresponding to one or more forces, touches or gestures detected via the sensor system.

8. The display apparatus of claim 1, wherein the display device control system is configured to send, via the interface system, one or more signals to the gaming machine control system, the one or more signals corresponding to the touch, gesture or force detected by the sensor system.

9. The apparatus of claim 1, further comprising an interface system that is configured to receive the player tracking information from a player loyalty card or from a mobile device and wherein the display device control system is configured to cause the one or more curved display side portions to display a color that corresponds with a player's level in a casino player loyalty program.

10. The apparatus of claim 9, wherein the interface system is configured for one or more of Bluetooth communication, infrared communication or near-field wireless communication.

11. The gaming apparatus of claim 9, wherein the display device control system is configured to cause, based at least in part on signals from the gaming machine control system, at least one of the curved display side portions to display one or more images corresponding to a portion of an attract sequence for a game while the gaming machine control system causes at least one other gaming machine component to display one or more images corresponding to another portion of the attract sequence.

12. The display apparatus of claim 1, wherein at the display device control system is configured to determine trajectory information corresponding to the touch, gesture or force detected by the sensor system and to control the display to display one or more images moving along a trajectory corresponding to the trajectory information.

13. The display apparatus of claim 12, wherein the display device control system is configured to send, via the interface system, at least some of the trajectory information to the gaming machine control system.

14. The display apparatus of claim 1, wherein the display device control system is configured to cause the main display portion to display the one or more images corresponding to a touch, gesture or force detected by the sensor system based, at least in part, on signals from the gaming machine control system.

15. The apparatus of claim 1, wherein the sensor system is configured for capturing one or more types of biometric information and wherein the display device control system or the gaming machine control system is configured to control access to EGM information based, at least in part, on the biometric information.

16. The gaming apparatus of claim 15, wherein the display device control system is configured to cause the main display portion to display one or more images corresponding to one or more of EGM diagnostic information, information regarding EGM software updates or EGM accounting information.

17. A method, comprising:

controlling a gaming machine to provide a wagering game, wherein providing the wagering game comprises controlling a first portion of a main display of the gaming machine to display primary images corresponding to presenting an instance of the wagering game, the first portion of the main display including a front portion; and controlling, during at least a portion of the time that the gaming machine is providing the wagering game, a second portion of the main display to display one or more secondary images or colors that do not correspond to presenting the instance of the wagering game, the second portion comprising at least one curved side portion of the main display, the one or more secondary images or colors corresponding to one or more of an attract sequence, one or more images corresponding with player tracking information, one or more colors corresponding with player tracking information, or advertising images; and receiving first player tracking information regarding a first person for whom the instance of the wagering game is being presented and receiving second player tracking information regarding a second person who is not currently playing the wagering game.

18. The method of claim 17, wherein the secondary images are viewable from an angle that is perpendicular to a normal to the first portion of the main display.

19. The method of claim 17, wherein the second player tracking information is received via a wireless interface system that is configured to receive player tracking information from a player loyalty card or from a mobile device.

20. The method of claim 17, wherein the one or more secondary images or colors indicate player identification information corresponding with the second player tracking information.

* * * * *